US009644315B2

(12) United States Patent
Kitagawa et al.

(10) Patent No.: US 9,644,315 B2
(45) Date of Patent: May 9, 2017

(54) METHOD FOR INKJET TEXTILE PRINTING

(71) Applicant: MATSUI SHIKISO CHEMICAL CO., LTD., Kyoto (JP)

(72) Inventors: Yosuke Kitagawa, Kyoto (JP); Masaki Kariya, Kyoto (JP); Daisuke Inoue, Kyoto (JP)

(73) Assignee: MATSUI SHIKISO CHEMICAL CO., LTD., Kyoto (JP)

( * ) Notice: Subject to any disclaimer, the term of this patent is extended or adjusted under 35 U.S.C. 154(b) by 234 days.

(21) Appl. No.: 14/141,880

(22) Filed: Dec. 27, 2013

(65) Prior Publication Data

US 2014/0186533 A1 Jul. 3, 2014

(30) Foreign Application Priority Data

Dec. 28, 2012 (JP) ..... 2012-287504

(51) Int. Cl.

| | |
|---|---|
| ***D06P 5/30*** | (2006.01) |
| ***D06P 1/52*** | (2006.01) |
| ***D06P 1/642*** | (2006.01) |
| ***D06P 1/66*** | (2006.01) |

(52) U.S. Cl.

CPC ..... *D06P 1/5285* (2013.01); *D06P 1/6424* (2013.01); *D06P 1/66* (2013.01); *D06P 5/30* (2013.01)

(58) Field of Classification Search

CPC ..... D06P 5/30

See application file for complete search history.

(56) References Cited

U.S. PATENT DOCUMENTS

| | | | | |
|---|---|---|---|---|
| 4,214,997 | A * | 7/1980 | Morris | C11D 3/0036 510/517 |
| 5,958,561 | A | 9/1999 | Held | |
| 6,001,137 | A * | 12/1999 | Alfekri | D06P 1/5278 8/445 |
| 2012/0306976 | A1* | 12/2012 | Kitagawa | C09D 11/326 347/100 |

FOREIGN PATENT DOCUMENTS

| | | | |
|---|---|---|---|
| JP | H11 315485 | A | 11/1999 |
| JP | 2003 268271 | A | 9/2003 |
| JP | 2006 218791 | A | 8/2006 |
| JP | 2009 215506 | A | 9/2009 |
| JP | 2009 215686 | A | 9/2009 |
| JP | 2010 503779 | A | 2/2010 |
| WO | 2008033569 | A2 | 3/2008 |

* cited by examiner

*Primary Examiner* — James M Mellott

(74) *Attorney, Agent, or Firm* — McGlew and Tuttle, P.C.

(57) ABSTRACT

Method for inkjet textile printing comprising a printing step for printing an aqueous pigment ink on a specifically pretreated portion of a textile fiber product by an inkjet process, wherein said specific pretreatment is performed by applying at least:

(A) a quaternary ammonium salt type cationic surfactant represented by the formula (1) below, and (B) a block isocyanate compound to the entire textile fiber product or a required portion thereof, and said aqueous pigment ink comprises at least a pigment, an aqueous liquid as a solvent or dispersion medium, and:

(C) a water-soluble dispersing agent having a crosslinking property, (D) a self-emulsifying type urethane resin, and (E) a block isocyanate compound.

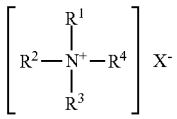

[Two of $R^1$ to $R^4$: alkyl having 8 to 18 carbon atoms; the remaining two: methyl or ethyl; $X^-$: anion.]

20 Claims, No Drawings

METHOD FOR INKJET TEXTILE PRINTING

BACKGROUND OF THE INVENTION

1. Field of the Invention

The present invention relates to a method for inkjet textile printing wherein an aqueous pigment ink is inkjet-printed on a textile fiber product after pretreatment and a textile fiber product prepared using the method.

2. Description of the Prior Art

In recent years, inkjet textile printing with an ink containing a dye or pigment as a colorant has been developed as a method of coloring a textile fiber product with the advantage of obviation of the need for plate making.

In the case of coloring with a dye, a textile fiber product, pretreated with a cellulose thickener or the like in advance, is then inkjet-printed with an ink containing a dye suitable for the kind of fiber as a colorant. Accordingly, inks containing reactive dyes or direct dyes for cellulose fibers such as cotton or hemp, acid dyes for animal fibers such as wool or silk, acid dyes or disperse dyes for nylon fibers, disperse dyes for polyester fibers, and cationic dyes for acrylic fibers, are used as colorants respectively. After inkjet printing, steps for steaming, washing, soaping, drying and so on are taken to yield a textile fiber product with desired pattern without plate making.

However, because a dye is used as a colorant, it is necessary to change the dye (hence the ink containing the dye) according to the kind of fiber, and problems arise from the complex processes following inkjet printing, such as for steaming, washing, soaping, and drying, and a tendency for increasing environmental load.

Meanwhile, in the case of coloring with an ink containing a pigment, which, unlike dyes, is a colorant that does not have substantivity for fibers, there are advantages in that unlike dyes, textile fiber products of various fibers can be colored with a single kind of ink, and that the environmental load is low because of the obviation of the need for steaming and washing steps after printing, although a binder is needed to bind the pigment to the fiber.

However, because pigments, unlike dyes, occur as insoluble color-imparting particles, inkjet printing using a pigment ink poses the problems of clogging in the fine nozzle of inkjet printing machine and the possible occurrence of time-related precipitation and flocculation of the pigment in the ink. The same poses other problems, including a tendency for film formation on the nozzle tip of inkjet printing machine and hence nozzle clogging caused by the binder needed to bind the pigment to the fiber, a tendency toward a hard feeling, and difficulty in obtaining sufficient fastness. Still another problem can arise when a pigment ink is printed directly on fiber: the pigment ink penetrates the fiber, making it difficult to obtain high-density patterns, and the pigment ink undergoes migration, making it difficult to obtain brilliant images.

Examples of past proposals concerning color impartment by an inkjet process using a pigment as a colorant include the techniques described in the references (1) to (6) below.

(1) JP-A-2003-268271

A technique for performing inkjet textile printing with excellent performance in printing stability, discharge stability, storage stability, and washing fastness by dispersing a pigment using an organic polymer compound having an anionic group, previously polymerized in a solvent, thereafter distilling off the solvent, adding an acid for acid deposition to cover the pigment surface with the organic polymer compound, and thereafter heating a fabric inkjet-printed using an ink prepared by blending a block isocyanate in a colorant solubilized by the addition of water and a base.

(2) JP-A-2009-215506

A technique for using a ink for inkjet textile printing to print a fabric comprising a pigment, a water-dispersible resin, a block isocyanate compound as a crosslinking agent, and water, and exhibiting good performance in color fastness to washing and rubbing.

(3) JP-A-2006-218791

A technique for using an inkjet recording material that exhibits excellent performance in image brilliancy, water resistance, light resistance, and chromogenicity, comprising a polylactic acid fiber base and an ink receiving layer formed thereon, the layer comprising an aqueous emulsion type acrylic adhesive having a glass transition point ranging from −50° C. to −10° C. and a water-soluble cationic polymer as primary components.

(4) JP-A-2009-215686

A method for inkjet textile printing having both high color fastness to rubbing and excellent chromogenicity and brilliancy, comprising pretreating a fabric with a water dispersion of a cationic polymer, thereafter coloring the fabric by inkjet, then post-treating with a dispersion of a block isocyanate in water, and heating at 120° C. to 210° C.

(5) JP-T-2010-503779

A method for digital printing of a fabric, comprising (a) a step for pretreating the fabric with an aqueous pretreatment solution containing a nonionic latex polymer and a polyvalent cation salt solution, (b) a step for drying the pretreated fabric, and (c) a step for digital printing the dry pretreated fabric with a color inkjet ink, wherein the nonionic latex polymer has a sufficient nonionic component to make it stable in the presence of the polyvalent cation salt solution.

(6) JP-A-HEI-11-315485

A technique concerning an inkjet-printed fabric having (a) an aqueous ink comprising an aqueous vehicle and a colorant and (b) a fabric to be printed with the aqueous ink, wherein the fabric has been treated with a hydrophilic composition containing at least one kind of crosslinkable thermoplastic polymer having a molecular weight of at least 6000, and selected from the group consisting of (1) a polymer having at least one carboxylic acid group and at least one crosslinkable group and (2) a polymer selected from the group consisting of mixtures of a first polymer having at least one carboxylic acid group and a second polymer having at least one crosslinkable group.

However, the proposals described in the aforementioned references (1) to (6) are problematic in the aspects shown below.

The technique described in the reference (1) cannot be said to be an appropriate method of obtaining a colorant because it requires the complex steps of once finely dispersing a pigment in a solvent system, then performing acid deposition to bind an organic polymer compound to the pigment surface, and thereafter blending a base to solubilize the pigment to obtain a colorant, its workability is low, and its process is painstaking. In addition, the pigment dispersion prepared by dispersing a pigment using such a pigment-dispersing agent is highly viscous, and when the pigment is dispersed to high density, the ink viscosity increases to the extent that the ink cannot be used for inkjet; therefore, the pigment dispersion is not considered to be suitable for an inkjet ink of high color density. In addition, when a fabric is colored with this ink formulated with a block isocyanate and subjected to a heat treatment, the bindability of the ink component to the fabric is weak, and it is unlikely that satisfactory fastness is obtained.

In the technique described in the reference (2), like the technique described in the reference (1), a block isocyanate compound is formulated as a crosslinking agent in a coloring ink only, and the crosslinking of the water-dispersible resin and block isocyanate compound in the coloring ink alone does not cause sufficient pigment binding to the fabric; therefore, this technique is not considered to ensure adequate fastness.

In the technique described in the reference (3), a fiber base is pretreated with a composition of an aqueous emulsion type acrylic adhesive and a water-soluble cationic polymer as the primary components in advance to cover the entire surface of the fiber base with a resin film; therefore, it is thought that the feeling of the fiber base hardens, and that the breathability is adversely affected. In addition, because inkjet printing is performed on a hydrophobic film, it is thought that brilliant images are difficult to obtain due to ink repellency.

The technique described in the reference (4) is intended to improve the fastness by pretreating a fabric with a cationic polymer to increase the color development density of inkjet prints, and post-treating the fabric with a block isocyanate compound; however, pretreatment with the polymer hardens the feeling. In addition, when inkjet printing is followed by a post-treatment with a block isocyanate, crosslinking of the binder and block isocyanate in the coloring ink occurs, improving the water resistance of the binder; however, the binding of the fabric and the pigment and binder is insufficient; therefore, this technique is not considered to ensure adequate fastness for a colored fabric.

The techniques described in the references (5) and (6), like the technique described in the reference (4), are considered to adversely affect the feeling because of pretreatment of the fabric with a polymer, and to make it difficult to obtain brilliant images due to ink repellency because of inkjet printing on a hydrophobic film.

As stated above, when using a dye as a colorant in coloring a textile fiber product by an inkjet process, clogging in the nozzle of inkjet apparatus is unlikely to occur, the ink discharge stability is good, and with dyeing affinity for fiber, the quality properties such as feeling and fastness of the colored textile fiber product are good. In this case, however, it is necessary to choose a dye according to the kind of fiber, and moreover, problems arise from the complex steps that cannot be said to be efficient, the cost requirements for equipment and resource consumption, and the relatively high environmental load by waste liquid.

Meanwhile, when using a pigment as a colorant in coloring a textile fiber product by an inkjet process, it is unnecessary to choose a pigment according to the kind of fiber, and the steps are relatively simple; however, this method poses problems concerning the long-term storage stability of the pigment ink, possible occurrence of clogging in the nozzle of inkjet apparatus and discharge stability reduction, and difficulty in obtaining good quality properties such as feeling and fastness of the colored textile fiber product.

For this reason, there is a demand for the development of a method of coloring a textile fiber product by an inkjet process using an ink containing a pigment as a colorant, which method enables the obtainment of brilliant images and a colored product with excellent color fastness and soft feeling while preventing clogging in the fine nozzle of inkjet printing machine.

SUMMARY OF THE INVENTION

The present invention has been developed in view of the above-described problems in the conventional art, and is intended to provide a method for inkjet textile printing that allows a textile fiber product to be brilliantly colored using a pigment ink with good quality-related properties such as feeling and color fastness, while preventing clogging in the nozzle of inkjet printing machine, and a textile fiber product prepared using the same.

[1] The present inventors conducted extensive investigations to solve the above-described problems, and have succeeded in developing a method for inkjet textile printing that allows a textile fiber product to be pigment-colored with soft feeling and excellent fastness by pretreating a subject textile fiber product with a particular cationic surfactant and block isocyanate compound, and thereafter inkjet-printing the subject textile fiber product with an aqueous pigment ink containing at least a water-soluble dispersing agent having a crosslinking property, a self-emulsifying type urethane resin, and a block isocyanate compound.

According to this method for inkjet textile printing, by pretreating a textile fiber product with a particular cationic surfactant and block isocyanate compound, inkjet textile printing of the textile fiber product with an aqueous pigment ink can be performed brilliantly and with high density while preventing bleeding and penetration to the maximum possible extent, and the block isocyanate compound used in the pretreatment and/or a block isocyanate compound in the aqueous pigment ink crosslink with the water-soluble dispersing agent having a crosslinking property and/or the crosslinking functional group in the self-emulsifying type urethane resin in the aqueous pigment ink, so that the water-soluble dispersing agent, the self-emulsifying type urethane resin, and the block isocyanate compound become a water-insoluble integral entity, and, while in a state containing the pigment, bind firmly to the fiber in the textile fiber product, whereby a pigment-colored textile fiber product with soft feeling and excellent fastness is obtained.

[2] The method for inkjet textile printing and textile fiber product of the present invention can be described as follows:

1. A method for inkjet textile printing comprising a printing step for printing an aqueous pigment ink on a specifically pretreated portion of a textile fiber product by an inkjet process, wherein said specific pretreatment is performed by applying at least:

(A) a quaternary ammonium salt type cationic surfactant represented by the formula (1) below, and (B) a block isocyanate compound to the entire textile fiber product or a required portion thereof, and said aqueous pigment ink comprises at least a pigment, an aqueous liquid as a solvent or dispersion medium, and:

(C) a water-soluble dispersing agent having a crosslinking property, (D) a self-emulsifying type urethane resin, and (E) a block isocyanate compound.

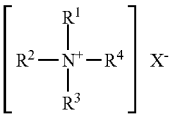

(1)

[In the formula (1), two of $R^1$ to $R^4$ mutually independently represent an alkyl group having 8 to 18 carbon atoms, the remaining two mutually independently represent a methyl group or an ethyl group, and $X^-$ represents an anion.]

2. The method for inkjet textile printing in 1 above, having a pretreatment step for performing the specific pretreatment on the entire textile fiber product or a required portion thereof prior to said printing step.

3. The method for inkjet textile printing in 1 or 2 above wherein the pretreatment is performed by applying a pretreatment agent containing at least:

(A) a cationic surfactant represented by the formula (1) and (B) a block isocyanate compound to the entire textile fiber product or a required portion thereof.

4. The method for inkjet textile printing in 1, 2 or 3 above wherein (B) the block isocyanate compound is a compound resulting from blocking of the isocyanate group in trimethylolpropane adduct form or isocyanurate form of:

hexamethylene diisocyanate, hydrogenated xylylene diisocyanate, isophorone diisocyanate, or dicyclohexylmethane diisocyanate.

5. The method for inkjet textile printing in 4 above wherein (B) the block isocyanate compound has been obtained using diethyl malonate, diisopropylamine, 1,2,4-triazole, 3,5-dimethylpyrazole, or 2-butanonoxime as a blocking agent.

6. The method for inkjet textile printing in any one of 1 to 5 above wherein the aqueous pigment ink is a dispersion liquid containing a dispersed pigment having a maximum particle diameter of not more than 500 nm.

7. The method for inkjet textile printing in any one of 1 to 6 above wherein (C) the water-soluble dispersing agent having a crosslinking property results from neutralization, with a basic substance, of an emulsion polymer having a molecular weight of 2,000 to 20,000 obtained from:

(1) 20 to 80 parts by weight of a (meth)acrylic acid ester monomer represented by $CH_2{=}CR^5{-}COOR^6$ [wherein $R^5$ represents a hydrogen atom or a methyl group, and $R^6$ represents an alkyl group having 2 to 8 carbon atoms.], (2) 80 to 20 parts of an aliphatic vinyl monomer having a carboxyl group, and (3) 0 to 20 parts of an aliphatic vinyl monomer having a crosslinking property.

8. The method for inkjet textile printing in 7 above wherein (2) the aliphatic vinyl monomer having a carboxyl group is at least one selected from the group consisting of acrylic acid, methacrylic acid, itaconic acid, maleic acid, and fumaric acid.

9. The method for inkjet textile printing in 7 or 8 above wherein the basic substance is a secondary amine or a tertiary amine.

10. The method for inkjet textile printing in any one of 1 to 9 above wherein the blending ratio of (C) the water-soluble dispersing agent having a crosslinking property in the aqueous pigment ink ranges from 0.05 to 2.0 parts by weight relative to 1.0 part by weight of the pigment.

11. The method for inkjet textile printing in any one of 1 to 10 above wherein the aqueous pigment ink contains a polyoxyethylene styrenated phenyl ether sulfate or a polyoxyethylene alkyl ether sulfate as a dispersing aid.

12. The method for inkjet textile printing in any one of 1 to 11 above wherein (D) the self-emulsifying type urethane resin has been obtained from a composition comprising at least:

an isocyanate and a polyol having a carboxyl group or a sulfonic acid group.

13. The method for inkjet textile printing in any one of 1 to 12 above wherein the glass transition point (Tg) of (D) the self-emulsifying type urethane resin is −60 to 20° C.

14. The method for inkjet textile printing in any one of 1 to 13 above wherein (E) the block isocyanate compound is a compound resulting from blocking the isocyanate group in trimethylolpropane adduct form or isocyanurate form of:

hexamethylene diisocyanate, hydrogenated xylylene diisocyanate, isophorone diisocyanate, or dicyclohexylmethane diisocyanate.

15. The method for inkjet textile printing in 14 above wherein (E) the block isocyanate compound has been obtained with diethyl malonate, diisopropylamine, 1,2,4-triazole, 3,5-dimethylpyrazole, or 2-butanonoxime as a blocking agent.

16. The method for inkjet textile printing in any one of 1 to 15 above wherein (E) the block isocyanate compound is water-soluble or self-emulsifying, and wherein the aqueous pigment ink is excellently redispersible.

17. The method for inkjet textile printing in any one of 1 to 16 above wherein the viscosity of the aqueous pigment ink is 3 to 30 mPa·s at 20° C.

18. The method for inkjet textile printing in any one of 1 to 17 above wherein the surface tension of the aqueous pigment ink is 20 to 40 mN/m.

19. The method for inkjet textile printing in any one of 1 to 18 above, having a heat treatment step for heating at least a portion on which an aqueous pigment ink is printed of a textile fiber product on which the aqueous pigment ink is printed by an inkjet process in said printing step.

20. The method for inkjet textile printing in any one of 1 to 19 above wherein the pretreatment is performed by applying at least:

(A) a cationic surfactant represented by the formula (1) above and (B) a block isocyanate compound to the entire textile fiber product or a required portion thereof by a padding process, coating process, screen printing process, inkjet process, or spraying process.

21. The method for inkjet textile printing in any one of 1 to 20 above, having a post-treatment step for post-treating at least a portion on which an aqueous pigment ink is printed of a textile fiber product on which the aqueous pigment ink is printed by an inkjet process in said printing step, by a padding process, coating process, screen printing process, inkjet process, or spraying process.

22. The method for inkjet textile printing in 21 above wherein the post-treatment is performed by applying at least one of acrylic resin emulsion, urethane resin emulsion, crosslinking agent, plasticizer, surfactant, and silicone-based softening agent to at least a portion on which an aqueous pigment ink is printed of said textile fiber product.

23. A textile fiber product printed by the method for inkjet textile printing in any one of 1 to 22 above.

[3] The present invention has been developed on the basis of the findings shown below.

(1) Problems in Inkjet Textile Printing Using a Pigment Ink

Inkjet textile printing using an ink with a pigment as a colorant is exemplified by:

a method comprising blending water, a hydrophilic solvent such as a wetting agent, an emulsion type resin as a binder, and the like with pigment using a nonionic surfactant or an anionic surfactant as a pigment-dispersing agent to obtain an ink, and thereafter textile printing a desired pattern on a textile fiber product with the ink;

a method comprising printing on a cloth pretreated with a cationic polymer and an acrylic emulsion resin (adhesive) in advance;

a method comprising dispersing a pigment using an organic polymer compound having an anionic group, previously polymerized in a solvent, then distilling off the solvent, thereafter adding an acid for acid deposition to cover the pigment surface with the organic polymer compound, thereafter adding water and a base to obtain a solubilized microcapsulated pigment, blending a block isocyanate in this covered pigment to obtain an ink, printing the ink by an inkjet process, and performing a heat treatment; a method comprising dispersing a pigment using a water-dispersible resin, adding a block isocyanate as a cross-linking agent, and performing a heat treatment, to achieve coloring with excellent fastness;

and the like; however, these methods have the problems shown below.

(1-1) When using a nonionic surfactant or an anionic surfactant as a pigment-dispersing agent, a pigment dispersion that possesses excellent long-term stability and is suitable for inkjet can be obtained because of their high dispersion capacity. However, when used to color a textile fiber product, this tends to inhibit pigment binding due to poor fiber affinity. In addition, the surfactant remaining on the textile fiber product has adverse effects on the color fastness to washing and rubbing and the like of the textile fiber product due to the water solubility thereof.

(1-2) For a microcapsulated pigment prepared by dispersing a pigment using an organic polymer compound having an anionic group, subjecting it to acid deposition, and redissolving it using a base, the water resistance can be improved by covering the pigment surface with the organic polymer; however, the productivity is poor because extremely complex production steps are required. In addition, because acid deposition and redissolution with a base are required after dispersion, some portion of the pigment flocculates, tending to cause color density reduction, precipitation and increased viscosity, nozzle clogging, and the like during long-time storage. In addition, a pigment dispersion prepared using a water-dispersible resin that also serves as a binder is dispersible in water and hence highly oleophilic, resulting in increased viscosity at the time of pigment dispersion. In addition, when the solvent water volatilizes, the pigment becomes insoluble in water and is likely to cause clogging at the nozzle tip.

(1-3) In the method wherein a cationic polymer and an acrylic emulsion resin are previously applied to the surface of a textile fiber product to bind a pigment to the textile fiber product, and the surface is inkjet-printed to bind the pigment to the textile fiber product, sufficient fastness cannot be retained because the bound pigment binds to the surface only ionically. In addition, while the cationic polymer is used in combination with an acrylic resin (adhesive), inkjet printing is performed on a dry resin film, so that the pigment adheres to the resin surface, and the degree of fastness is insufficient. In addition, because a pretreatment agent is applied over the entire textile fiber product, the feeling and touch worsen, and the breathability tends to be adversely affected. On the other hand, to bind the pigment to the textile fiber product surface without pretreatment, it is necessary to blend a large amount of an emulsion resin for binding in the ink. Although the emulsion resin for binding is capable of firmly bonding the pigment to the textile fiber product, it forms a water-insoluble film upon drying; therefore, large-amount blending thereof can cause inkjet nozzle clogging and hardens the feeling of the colored portion in the textile fiber product.

(1-4) Although the occurrence of inkjet nozzle clogging due to large-amount blending of an emulsion resin in (1-3) above may be prevented by blending a large amount of wetting agent to delay the drying, blending of a large amount of wetting agent can significantly reduce the fastness of the colored portion in the textile fiber product, and even when a wetting agent is blended in a large amount, nozzle tip clogging cannot be prevented completely.

(1-5) In the method wherein a block isocyanate and water are added to a pigment covered with an organic polymer compound having a carboxyl group, inkjet printing is performed, and thereafter heating is performed to color a textile fiber product, the pigment can be water-insolubilized on the textile fiber product surface through the reaction of the carboxyl group and the isocyanate group; however, as stated above, the covered pigment in an inkjet ink tends to deteriorate the long-term storage stability of the inkjet ink due to the complex production steps. In addition, through the reaction of the carboxyl group and the isocyanate group only, it is difficult to obtain sufficient color fastness (fastness to washing, fastness to rubbing, and the like) at the colored portion in the textile fiber product.

(2) Solutions to the Problems (2-1) By applying a particular cationic surfactant to a textile fiber product in a pretreatment, an ion complex is formed with an aqueous pigment ink to prevent bleeding and penetration to the maximum possible extent, thus enabling brilliant printing with high density. Because no resin is used in the pretreatment, the feeling of the textile fiber product is not adversely affected.

(2-2) Use of a cationic surfactant in (2-1) above is feared to reduce fastness properties such as water resistance; however, by using a block isocyanate compound in the pretreatment above, and also using a water-soluble dispersing agent having a crosslinking property and a self-emulsifying type urethane resin in the aqueous pigment ink, the block isocyanate compound in the pretreatment and the water-soluble dispersing agent having a crosslinking property and/or the crosslinking functional group in the self-emulsifying type urethane resin in the aqueous pigment ink crosslink with each other, making the pigment, the water-soluble dispersing agent having a crosslinking property, the self-emulsifying type urethane resin, and the block isocyanate compound an integral entity, and ensuring sufficient fastness.

(2-3) By blending a pigment dispersion obtained using a water-soluble dispersing agent having a crosslinking property, a self-emulsifying type urethane resin as a binder, and a block isocyanate compound as a crosslinking agent, an aqueous pigment ink for inkjet that is of low viscosity and high color density and possesses excellent printing workability and long-term storage stability, is obtained. Furthermore, the block isocyanate compound in the pretreatment and/or the block isocyanate compound in the aqueous pigment ink and the water-soluble dispersing agent having a crosslinking property and/or the crosslinking functional group in the self-emulsifying type urethane resin in the aqueous pigment ink crosslink with each other, whereby they become water-insoluble and function as a pigment binder; therefore, a textile fiber product possessing good fastness in the colored portion is obtained while preventing the feeling from being adversely affected.

(3) According to the method for inkjet textile printing of the present invention, which is based on the above-described aspects, in addition to the advantages of conventional inkjet textile printing arising from the possibility of textile printing without plate making, i.e., small lot size, multiple varieties, quick delivery, no requirement of plate making cost, and possibility of extremely efficient textile printing, inkjet printing of a textile fiber product with an aqueous pigment ink can be performed brilliantly with high density while preventing bleeding and penetration to the maximum possible extent by pretreating a textile fiber product with a particular cationic surfactant and block isocyanate compound, and the block isocyanate compound used in the pretreatment and/or the block isocyanate compound in the aqueous pigment ink and the water-soluble dispersing agent having a crosslinking property and/or the crosslinking functional group in the self-emulsifying type urethane resin in the aqueous pigment ink crosslink with each other, whereby the water-soluble dispersing agent, the self-emulsifying type urethane resin, and the block isocyanate compound become a water-insoluble integral entity, and, while in a state containing the pigment, bind firmly to the fiber in the textile fiber product, whereby a pigment-colored textile fiber product with soft feeling and excellent fastness is obtained.

In the method for inkjet textile printing of the present invention, an ion complex is formed by a particular cationic surfactant and an aqueous pigment ink in a pretreatment, and the block isocyanate compound in the pretreatment and/or the block isocyanate compound in an aqueous pigment ink and the water-soluble dispersing agent having a crosslinking property and/or the crosslinking functional group in the self-emulsifying type urethane resin in the aqueous pigment ink crosslink with each other, or moreover the block isocyanate compound itself condenses, a desired effect is obtained; if any constituent is lacking, the object of the present invention cannot be accomplished. Accordingly, the configuration of the present invention is of particular significance.

According to the present invention, by pretreating a textile fiber product with a particular cationic surfactant and block isocyanate compound, inkjet printing of an aqueous pigment ink on the textile fiber product can be performed brilliantly with high density while preventing bleeding and penetration to the maximum possible extent, and the block isocyanate compound used in the pretreatment and/or the block isocyanate compound in the aqueous pigment ink and the water-soluble dispersing agent having a crosslinking property and/or the crosslinking functional group in the self-emulsifying type urethane resin in the aqueous pigment ink crosslink with each other, whereby the water-soluble dispersing agent, the self-emulsifying type urethane resin, and the block isocyanate compound become a water-insoluble integral entity, and, while in a state containing the pigment, bind firmly to the fiber in the textile fiber product, whereby a pigment-colored textile fiber product with soft feeling and excellent fastness is obtained.

DETAILED DESCRIPTION OF THE INVENTION

Modes for embodying the present invention are described below.

(1) Textile Fiber Product

Textile fiber products that can serve as the subject for the method for inkjet textile printing of the present invention include fabrics, knits, non-woven fabrics, gigged cloths, and the like configured with various fibers, whether in the form of material cloths, garments (shirts, sweatshirts, jerseys, pants, one-piece dresses, blouses, hats and caps, socks, and the like), apparel accessories (handkerchiefs, neckties, cloth belts, and the like), or other products (shoes, beddings, bed sheets, curtains, car seats, bags, flags, and the like). Even those having a portion configured with a non-fiber component are, as a rule, not excluded from the scope of the subject.

The fiber that constitutes the textile fiber product, as a rule, is also subject to no limitation; for example, the subject may be a textile fiber product configured by any one of various synthetic fibers, semi-synthetic fibers, natural fibers, and inorganic fibers (including mixed-spun fabrics thereof) such as nylon, polyester, acryl, lactate fiber, acetate, rayon, cotton, silk, wool, hemp, and glass fiber.

Not only for white fiber products, but also for chromatic fiber products, a desired pattern and the like including a color image can be formed by, for example, textile printing with a white masking aqueous pigment ink using the method for inkjet textile printing of the present invention, and thereafter textile printing with a chromatic aqueous pigment ink using the method for inkjet textile printing of the present invention.

(2) Pretreatment

The method for inkjet textile printing of the present invention encompasses not only methods comprising a pretreatment step for a textile fiber product, but also cases where a pretreatment has previously been performed on the textile fiber product.

The pretreatment in the present invention is performed by applying at least:

(A) a quaternary ammonium salt type cationic surfactant represented by the formula (1) above and (B) a block isocyanate compound to the entire textile fiber product or a required portion thereof.

In this pretreatment, a cationic surfactant of the formula (1) and a block isocyanate compound may be separately applied to a textile fiber product (e.g., impregnated in, or bonded to, the textile fiber product), and a single pretreatment agent containing both may also be applied to a textile fiber product.

(a) Quaternary Ammonium Salt Type Cationic Surfactant Represented by Formula (1)

By applying a quaternary ammonium salt type cationic surfactant of the formula (1) to the entire textile fiber product or a desired portion thereof in the pretreatment, an ion complex is formed with the aqueous pigment ink that is to be subsequently inkjet-printed. For this reason, without causing color fastness reduction, the bleeding and penetration of aqueous pigment ink is prevented to the maximum possible extent, enabling brilliant inkjet printing with high color density using the aqueous pigment ink.

In the pretreatment, a quaternary ammonium salt type cationic surfactant of the formula (1) can be applied to a textile fiber product in an amount that prevents the bleeding and penetration of the aqueous pigment ink. If the amount applied is large, fastness properties such as water resistance can decrease, and if the amount applied is small, the prevention of bleeding and penetration can become insufficient.

Any two of $R^1$ to $R^4$ in the formula (1) should be mutually independently alkyl groups having 8 to 18 carbon atoms, and the other two should be mutually independently a methyl group or an ethyl group.

When two of the aforementioned four alkyl groups is a methyl group or an ethyl group, the quaternary ammonium salt type cationic surfactant of the formula (1) becomes water-soluble, and, when constituting a pretreatment agent along with a block isocyanate compound, makes the storage stability of the pretreatment agent good.

If the carbon number of one or both of the other two alkyl groups in the aforementioned four alkyl groups is less than 8, the water resistance decreases. Meanwhile, if the carbon number of one or both of the two alkyl groups is more than 18, brilliant inkjet textile printing of an aqueous pigment ink with high color density becomes difficult to perform, and, when the quaternary ammonium salt type cationic surfactant of the formula (1) constitutes a pretreatment agent along with a block isocyanate compound, the storage stability of the pretreatment agent decreases due to increased likelihood of phase separation and the like.

The alkyl group having 8 to 18 carbon atoms in the formula (1) may be linear or branched; examples include, but are not limited to, octyl group, nonyl group, decyl group, dodecyl group, tetradecyl group, octadecyl group, isooctyl group, 2,4-dimethylhexyl group, 4-ethyl-2-methylheptyl group, and the like.

For the quaternary ammonium salt type cationic surfactant of the formula (1), when all of the four alkyl groups are methyl groups or ethyl groups, the hydrophilicity increases, but the fastness of the colors imparted by the aqueous pigment ink decreases. Meanwhile, when all of the four alkyl groups have a carbon number of 8 to 18, the hydrophobicity of the surfactant of the formula (1) increases, so that the water resistance improves, but water-solubility is not achieved. Furthermore, if only one alkyl group has 8 to 18 carbon atoms, the water resistance of the surfactant of the formula (1) is insufficient; when two alkyl groups have 8 to 18 carbon atoms and the other two alkyl groups are methyl group(s) or ethyl group(s) in a ratio of 1:1 of both, an appropriate balance is obtained between the water solubility and the color fastness.

$X^-$ in the formula (1) represents an anion. Examples of the anion include halide ion, inorganic acid ion, organic acid ion, and hydroxide ion. More specific examples of halide ion, inorganic acid ion, and organic acid ion include, but are not limited to, chloride ion, bromide ion, sulfate ion, nitrate ion, phosphate ion, acetate ion, malonate ion, and the like.

(B) Block Isocyanate Compound

As the block isocyanate compound used in the pretreatment in the present invention, one having a group that is reactive with (C) a water-soluble dispersing agent having a crosslinking property and (D) a crosslinking functional group in a self-emulsifying type urethane resin upon heating (preferably heating at 100° C. or higher) (e.g., one having 2 or 3 or more such groups) can be used.

When applying the block isocyanate compound in the present invention to a textile fiber product in pretreatment, the compound crosslinks with the water-soluble dispersing agent having a crosslinking property and self-emulsifying type urethane resin in the aqueous pigment ink that is to be used for inkjet printing, and they become water-insoluble and bind to the textile fiber product. In addition, the block isocyanate compound itself condenses and binds to the textile fiber product, thus capable of exhibiting a primer-like function.

In the pretreatment, the block isocyanate compound is preferably applied to the textile fiber product in an amount at least larger than the amount that just fits the reacting water-soluble dispersing agent having a crosslinking property and the number of crosslinking functional groups in the self-emulsifying type urethane resin. If the amount applied is too large, the feeling of the textile fiber product can harden, and if the amount applied is small, the color fastness can decrease.

The block isocyanate compound is preferably a compound resulting from blocking the isocyanate group in:

TMP (trimethylolpropane) adduct form or isocyanurate form of:

HDI (hexamethylene diisocyanate),

H6XDI (hydrogenated xylylene diisocyanate),

IPDI (isophorone diisocyanate), or

H12MDI (dicyclohexylmethane diisocyanate).

In this case, the blocking agent is preferably DEM (diethyl malonate), DIPA (diisopropylamine), TRIA (1,2,4-triazole), DMP (3,5-dimethylpyrazole), or MEKO (2-butanonoxime), which, however, are not to be construed as limiting.

The block isocyanate compound (B) in the present invention can be used as an oligomer resulting from reacting some of the isocyanate groups thereof with polyol, polycarbonate, polyester, or polyether, or the like.

(3) Pretreatment Agent

The pretreatment agent used to pretreat a textile fiber product in the present invention contains at least:

(A) a quaternary ammonium salt type cationic surfactant represented by the formula (1) and (B) a block isocyanate compound.

In addition to the above-described components, the pretreatment agent may be blended as appropriate with water, a water-soluble organic solvent, an antioxidant, a drying inhibitor, an ultraviolet absorbent, a crosslinking catalyst, a plasticizer, a defoaming agent, and the like.

In the pretreatment agent, the amount blended of the quaternary ammonium salt type cationic surfactant represented by the formula (1) can be, for example, 0.5 to 20% by weight, and the amount blended of the block isocyanate compound can be, for example, 0.5 to 15% by weight.

The amount blended of the quaternary ammonium salt type cationic surfactant of the formula (1) in the pretreatment agent need to be an amount that prevents the bleeding and penetration of the aqueous pigment ink, and is preferably not more than 20 parts, more preferably not more than 10 parts, still more preferably not more than 5 parts, relative to 100 parts of the pretreatment agent. If the amount blended is large, color fastness properties such as water resistance decrease, and if the amount blended is small, it is feared that the bleeding and penetration of the aqueous pigment ink cannot be prevented.

It is desirable that the amount blended of the block isocyanate compound in the pretreatment agent be an amount larger than the amount that just fits the reacting water-soluble dispersing agent having a crosslinking property and the number of crosslinking functional groups in the self-emulsifying type urethane resin. The amount blended of the block isocyanate compound relative to 100 parts of the pretreatment agent is preferably not more than 15 parts, more preferably not more than 10 parts, still more preferably not more than 5 parts. If the amount blended is larger than these levels, the feeling of the textile fiber product can harden, and if the amount blended is smaller, the color fastness can decrease.

(4) Method of Pretreatment

The pretreatment in the present invention can be performed by applying a cationic surfactant represented by the formula (1) and a block isocyanate compound (or a pretreatment agent containing at least them) to the entire textile fiber product or a required portion thereof by padding process, coating process, screen printing process, inkjet process, or spraying process.

After thus applying a pretreatment agent and the like to a textile fiber product, the textile fiber product can be inkjet-printed with an aqueous pigment ink in a wet state, or after being dried, or after being subjected to a heat treatment.

(5) Printing Step

In the method for inkjet textile printing of the present invention, a portion that has been subjected to the aforementioned pretreatment of a textile fiber product is printed with an aqueous pigment ink by an inkjet process.

All of the desired portions in the subject textile fiber product may be subjected to a printing step after completing the pretreatment step for all of the desired portions; in addition, for example, some desired portions in the subject textile fiber product may be sequentially subjected to a pretreatment step, and before completing the pretreatment step for all of the desired portions, the portions for which the pretreatment step has been completed may be sequentially subjected to a printing step.

(6) Aqueous Pigment Ink

In the present invention, the aqueous pigment ink comprises at least a pigment, an aqueous liquid as a solvent or dispersion medium, and:

(C) a water-soluble dispersing agent having a crosslinking property, (D) a self-emulsifying type urethane resin, and (E) a block isocyanate compound.

(C) Water-Soluble Dispersing Agent Having a Crosslinking Property

The water-soluble dispersing agent having a crosslinking property in the present invention and (D) a self-emulsifying type urethane resin crosslink with (B) the block isocyanate compound in the pretreatment and/or (E) the block isocyanate compound in the aqueous pigment ink, whereby they become a water-insoluble integral entity, and, while in a state containing the pigment, bind firmly to the fiber in the textile fiber product.

The water-soluble dispersing agent having a crosslinking property in the present invention is exemplified by one prepared by neutralizing:

(C4) an emulsion polymer consisting of:

(C1) a (meth)acrylic acid ester monomer, (C2) an aliphatic vinyl monomer having a carboxyl group, and (C3) an aliphatic vinyl monomer having a crosslinking property with (C5) a basic substance.

In the present invention, the blending ratio of the water-soluble dispersing agent having a crosslinking property in the aqueous pigment ink preferably ranges from 0.05 to 2.0 parts by weight relative to 1.0 part by weight of the pigment; if the blending ratio is lower than 0.05, the dispersion viscosity can increase, and if the blending ratio is higher than 2.0, the time-related viscosity stability can decrease.

(C1) (Meth)Acrylic Acid Ester Monomer

As the (meth)acrylic acid ester monomer, one represented by $CH_2{=}CR^5{-}COOR^6$ [wherein $R^5$ represents a hydrogen atom or a methyl group, and $R^6$ represents an alkyl group having 2 to 8 carbon atoms.] can be used suitably.

When $R^6$ is a hydrogen atom or an alkyl group having 1 carbon atom, the colored portion of the textile fiber product lacks water resistance or becomes insufficiently resistant to water; when $R^6$ is an alkyl group having not less than 9 carbon atoms, the pigment dispersibility worsens; when $R^6$ has an aromatic ring, the viscosity of the aqueous pigment ink increases, and the time-related viscosity stability worsens.

Examples of this (meth)acrylic acid ester monomer include ethyl (meth)acrylate, propyl (meth)acrylate, butyl (meth)acrylate, pentyl (meth)acrylate, hexyl (meth)acrylate, heptyl (meth)acrylate, 2-ethylhexyl (meth)acrylate, and the like. In the present invention, such (meth)acrylic acid ester monomers may be used alone or in combination of two kinds or more.

(C2) Aliphatic Vinyl Monomer Having a Carboxyl Group

Examples of the aliphatic vinyl monomer having a carboxyl group include acrylic acid, methacrylic acid, itaconic acid, maleic acid, fumaric acid, and the like. In the present invention, such aliphatic vinyl monomers having a carboxyl group may be used alone or in combination of two kinds or more.

(C3) Aliphatic Vinyl Monomer Having a Crosslinking Property

As the aliphatic vinyl monomer having a crosslinking property, an aliphatic vinyl monomer having a crosslinking functional group other than a carboxyl group that is copolymerizable with the aforementioned (meth)acrylic acid ester monomer can be used. Examples include, but are not limited to, (meth)hydroxy acrylate, (meth)acrylonitrile, acrylamide, vinyl monomers containing a urethane group with a hydroxyl group, epoxy group-containing vinyl monomers, ester group-containing vinyl monomers formed from a monomer of a higher carboxylic acid and polyalcohol or the like, silicone group-containing vinyl monomers that form an organosiloxane and the like, vinylsulfonic acid, 2-acrylamide-2-methylpropanesulfonic acid, sulfuric acid esters of 2-hydroxyalkyl (meth)acrylate, vinylphosphonic acid, phosphoric acid esters of hydroxyalkyl(meth)acrylate, (meth)acrylate alkylphosphonic acid, vinyl alcohol, N-ethylmethacrylamide, N-isopropylacrylamide, N-vinylpyrrolidone, and the like.

(C4) Emulsion Polymer

The monomer can be polymerized by, for example, vinyl polymerization using an ordinary method of emulsification polymerization. For example, a desired emulsion polymer is obtained by carrying out a reaction in the presence of a polymerization catalyst, (C4-a) an emulsifying dispersing agent, and (C4-b) a chain transfer agent at 50 to 90° C. for about 4 to 10 hours.

The ratio of (C1) (meth)acrylic acid ester monomer that is suitable for the present invention ranges from 20 to 80 parts, more preferably from 30 to 70 parts, relative to 100 parts of the total monomer content, and from the viewpoint of the fastness of the colored portion, the ratio still more preferably ranges from 40 to 60 parts. If the ratio is less than 20 parts, water resistance is difficult to obtain after crosslinking, and if the ratio exceeds 80 parts, the emulsion polymer is unlikely to become water-soluble even when neutralized with a basic substance.

From the viewpoint of viscosity reduction at the time of pigment dispersion and time-related viscosity stability, the ratio of (C2) aliphatic vinyl monomer having a carboxyl group that is suitable for the present invention is 80 to 20 parts relative to 100 parts of the total monomer content. Preferably, the ratio ranges from 70 to 30 parts, still more preferably from 60 to 40 parts. If the ratio exceeds 80 parts, water resistance is difficult to obtain in the colored portion after crosslinking, and if the ratio is less than 20 parts, the emulsion polymer is unlikely to become water-soluble.

The ratio of (C3) aliphatic vinyl monomer having a crosslinking property that is suitable for the present invention is 0 to 20 parts, more preferably 0 to 15 parts, relative to 100 parts of the total monomer content. If the ratio exceeds 20 parts, the pigment dispersibility decreases, and, depending on the kind of monomer, the emulsion polymer cannot become water-soluble.

The molecular weight obtained after polymerization may be, for example, 2,000 to 20,000, preferably ranges from 3,000 to 10,000. If the molecular weight exceeds 20,000, the dispersion viscosity is likely to be high, and the pigment dispersibility can decrease. If the molecular weight is less than 2,000, the bindability of the pigment can be insufficient.

(C4-a) Emulsifying Dispersing Agent

As the emulsifying dispersing agent, a nonionic or anionic surfactant, for example, can be used. In particular, the water resistance of the colored portion improves when using a reactive surfactant that is copolymerizable with the monomer at the time of polymerization.

Examples of the reactive surfactant include, but are not limited to, polyoxyethylene alkenyl ether ammonium sulfate, polyoxyethylene nonylpropenylphenyl ether, polyoxyalkylene alkenyl ether ammonium sulfate, polyoxyalkylene alkenyl ether, and the like. These surfactants may be used alone or in combination of two kinds or more.

(C4-b) Chain Transfer Agent

The chain transfer agent is intended to adjust the emulsion polymer to a desired molecular weight of 2,000 to 20,000; examples include mercapto compounds, carbon tetrachloride, alpha-methylstyrene dimers, and the like, and use of a mercapto-based chain transfer agent such as n-octylmercaptan, n-dodecylmercaptan, 3-mercapto propionate, 3,3'-thiodipropionic acid, or thioglycolic acid is suitable in controlling the molecular weight.

The amount blended of the chain transfer agent preferably ranges from 0.02 to 0.1 (ratio by weight), still more preferably from 0.04 to 0.08, relative to 1.0 of the total monomer content.

(C5) Basic Substance

The basic substance is used as a neutralizing agent for the emulsion polymer, and may be any basic substance. For example, ammonia, basic metal salts, primary amine compounds, secondary amine compounds, tertiary amine compounds, and the like can be used. Above all, in view of increasing the resolubility of the pigment dispersion, it is preferable that neutralization be performed with a secondary or tertiary amine compound. The emulsion polymer is neutralized to a pH of 6 to 9 with these basic compounds to yield a water-soluble dispersing agent having a crosslinking property.

Neutralizing agents include, but are not limited to, isopropylamine, t-butylamine, n-propylamine, N,N-dimethylethanolamine, diethylethanolamine, diethanolamine, triethylamine, triethanolamine, and the like. These may be used alone or in combination of two kinds or more.

(D) Self-Emulsifying Type Urethane Resin

The self-emulsifying type urethane resin in the present invention and (C) a water-soluble dispersing agent having a crosslinking property crosslink with (B) the block isocyanate compound in the pretreatment and/or (E) the block isocyanate compound in the aqueous pigment ink, whereby they become a water-insoluble integral entity, and, while in a state containing the pigment, bind firmly to the fiber in the textile fiber product and pigment-color the textile fiber product.

Generally, urethane resins are roughly divided into the water-soluble type, the self-emulsifying type, and the forcibly emulsified type.

A water-soluble type urethane resin has been polymerized using a hydrophilic polyol; because the resin itself is water-soluble, it is difficult to obtain desired water resistance for the colored portion when the resin is blended in the aqueous pigment ink. A forcibly emulsified type urethane resin has been polymerized in the presence of a surfactant; the resin itself is hydrophobic, the particle diameter is large, film formation is likely to occur when the resin is blended in the aqueous pigment ink, defective pixels and print irregularity are likely to occur due to head nozzle tip clogging when continuous printing is performed, and the long-term storage stability of the aqueous pigment ink is low.

Meanwhile, a self-emulsifying type urethane resin has been prepared by conferring a hydrophilic group to one end of urethane resin, and emulsifying the urethane resin in water by the action of the hydrophilic group. When blended in an aqueous pigment ink, a self-emulsifying type urethane resin has a fine particle diameter, is unlikely to form a film, is suitable for continuous printing, and possesses excellent long-term storage stability. In addition, a self-emulsifying type urethane resin becomes hydrophobic when crosslinking the terminal hydrophilic group thereof with a block isocyanate compound, and, along with the crosslinked form of (C) a water-soluble dispersing agent having a crosslinking property, becomes a pigment binder with excellent fastness.

As the self-emulsifying type urethane resin in the present invention, for example, a self-emulsifying type urethane resin prepared by dispersing in water a urethane prepolymer consisting at least of a polyol, an isocyanate, an anionic group-incorporating polyol wherein said anionic group is selected from a carboxyl group and/or a sulfonic acid group using an anionic group-neutralizing agent to elongate the chain can be used.

The aforementioned polyol component is not particularly limited; for example, polyether polyols, polyester polyols, polyester polycarbonate polyols, and the like can be used.

More specifically, examples include low-molecular-weight polyols such as ethylene glycol, diethylene glycol, 1,2-propylene glycol, 1,3-propylene glycol, 1,2-butylene glycol, 1,3-butylene glycol, 1,4-butylene glycol, hexamethylene glycol, and ethylene oxide and/or propylene oxide addition products of hydrogenated bisphenol A; polyethylene glycol; polypropylene glycol; polytetramethylene glycol; polyether polyols prepared by adding ethylene oxide and/or propylene oxide with such a low-molecular-weight polyol as an initiator; polyester polyols prepared by an esterification reaction of such a low-molecular-weight polyol and a polyvalent carboxylic acid such as oxalic acid, malonic acid, succinic acid, or adipic acid, or an ester, acid anhydride or the like thereof; reaction products of a polyester glycol and an alkylene carbonate such as polycaprolactone polyol; polyester polycarbonate polyols that are reaction products prepared by reacting an organic dicarboxylic acid with a reaction product of ethylene carbonate and a polyhydric alcohol.

The isocyanate is not particularly limited; diisocyanates, polyisocyanates having three or more isocyanate groups in the molecular structure thereof, and the like can be used.

Examples of diisocyanates include aromatic diisocyanates such as tolylene diisocyanate, diphenylmethane-4,4'-diisocyanate, p-phenylene diisocyanate, xylylene diisocyanate, 1,5-naphthylene diisocyanate, 3,3'-dimethyldiphenyl-4,4'-diisocyanate, dianisidine diisocyanate, and tetramethylxylylene diisocyanate; alicyclic diisocyanates such as isophorone diisocyanate, dicyclohexylmethane-4,4'-diisocyanate, and norbornene diisocyanate; aliphatic diisocyanates such as 1,6-hexamethylene diisocyanate and lysine diisocyanate; and mixtures thereof.

Examples of polyisocyanates include trifunctional or more highly functional isocyanates such as triphenylmethane triisocyanate, 1-methylbenzole-2,4,6-triisocyanate, dimethyltriphenylmethane tetraisocyanate, and mixtures thereof; modification products such as carbodiimide modification products, isocyanurate modification products, and biuret modification products of these trifunctional or more highly functional isocyanates; block isocyanates resulting from blocking them with various blocking agents; isocyanurates (trimers) and biuret trimers of the aforementioned diisocyanates, and the like.

As the aforementioned anionic group-incorporating polyol, polyols containing a carboxyl group and/or a sulfonic acid group, for example, can be used. Specific examples include, but are not limited to, carboxyl group-containing polyols such as dimethylol propionic acid, dimethylol butanoic acid, dimethylol butyric acid, and dimethylol valeric acid; and sulfonic acid group-containing polyols such as 1,4-butanediol-2-sulfonic acid.

Basic compounds can be used as neutralizing agents for anionic groups. Examples include, but are not limited to, ammonia, basic metal salts, primary amine compounds, secondary amine compounds, tertiary amine compounds, and the like.

Various additives in common use may be added as required to the self-emulsifying type urethane resin of the present invention. Such additives include, for example, viscosity regulators, defoaming agents, antioxidants, ultraviolet absorbents, plasticizers, antistatic agents, and the like.

To soften the feeling of the textile fiber product, it is preferable that the glass transition point (Tg) of the self-emulsifying type urethane resin of the present invention range from −60 to 20° C. The glass transition point (Tg) more preferably ranges from −40 to 0° C., still more preferably from −30 to −10° C.

The self-emulsifying type urethane resin of the present invention is intended to bind a pigment to a textile fiber product, and if the amount blended is large, the fastness improves but the feeling of the colored portion hardens. Therefore, the amount blended of the self-emulsifying type urethane resin relative to 100 parts of the aqueous pigment ink of the present invention is preferably not more than 50 parts, more preferably not more than 30 parts, and still more preferably not more than 20 parts.

(E) Block Isocyanate Compound

As the block isocyanate compound in the aqueous pigment ink in the present invention, one having a group that is reactive with (C) a water-soluble dispersing agent having a crosslinking property and (D) a crosslinking functional group in a self-emulsifying type urethane resin upon heating (e.g., heating at 100° C. or higher) (e.g., one having 2 or 3 or more such groups) can be used.

The block isocyanate compound is preferably a compound resulting from blocking the isocyanate group in TMP (trimethylolpropane) adduct form or isocyanurate form of:

HDI (hexamethylene diisocyanate),
H6XDI (hydrogenated xylylene diisocyanate),
IPDI (isophorone diisocyanate), or
H12MDI (dicyclohexylmethane diisocyanate).

In this case, the blocking agent is preferably DEM (diethyl malonate), DIPA (diisopropylamine), TRIA (1,2,4-triazole), DMP (3,5-dimethylpyrazole), or MEKO (2-butanonoxime), which, however, are not to be construed as limiting.

The block isocyanate compound (E) in the present invention can be used as an oligomer resulting from reacting some of the isocyanate groups thereof with polyol, polycarbonate, polyester, polyether, or the like.

It is preferable that (E) the block isocyanate compound in the present invention be blended in an aqueous pigment ink after being rendered water-soluble or self-emulsifying by providing a hydrophilic group. Thereby the aqueous pigment ink can be made to be of low viscosity and excellent redispersibility.

It is desirable that the amount blended of the block isocyanate compound in the aqueous pigment ink be an amount larger than the amount that just fits the reacting water-soluble dispersing agent having a crosslinking property and the number of crosslinking functional groups in the self-emulsifying type urethane resin; the amount blended of the block isocyanate compound relative to 100 parts of the aqueous pigment ink is preferably not more than 30 parts, more preferably not more than 20 parts, still more preferably not more than 10 parts. If the amount blended is larger, the feeling of the textile fiber product can harden, and if the amount blended is smaller, the color fastness can decrease.

(F) Pigment

As a rule, any pigment can be used for the aqueous pigment ink of the present invention, as far as it is a pigment that can be used as a coloring material for fiber products, whether an organic pigment or an inorganic pigment.

For example, black pigments such as carbon black and iron oxide black pigment; yellow pigments such as azo pigments, imidazolone pigments, and titanium yellow pigments; red pigments such as azo pigments, quinacridone pigments, chromophtal pigments, diketopyrrolopyrrole pigments, and anthraquinone pigments; blue pigments such as phthalocyanine pigments; white pigments such as titanium oxide, aluminum silicate, and silicon oxide; orange pigments such as indanthrene pigments; purple pigments such as dioxazine pigments; green pigments such as phthalocyanine pigments; and the like can be used, which, however, are not to be construed as limiting.

(G) Aqueous Liquid

An aqueous liquid is used as a solvent or dispersion medium in the aqueous pigment ink.

As the aqueous liquid, water or a mixture of water and a water-soluble organic solvent and the like can be used.

Examples of water-soluble organic solvents include, but are not limited to:

glycol and glycerin solvents such as ethylene glycol, diethylene glycol, triethylene glycol, propylene glycol, butylene glycol, glycerin, and diglycerin as wetting agents;

methanol, ethanol, n-propanol, isopropanol, n-butanol, isobutanol, t-butanol, 2-pyrrolidone, N-methyl-2-pyrrolidone, propylene glycol monomethyl ether, ethylene glycol monoethyl ether, ethylene glycol monomethyl ether, methyl ethyl ketone, ethyl acetate, and ethylene glycol mono-n-butyl ether as surface tension, solubility, or drying speed regulators;

and the like. Such water-soluble organic solvents may be used alone or in combination of two kinds or more.

(7) Preparation of Aqueous Pigment Ink

The aqueous pigment ink in the present invention comprises at least a pigment, an aqueous liquid as a solvent or dispersion medium, and:

(C) a water-soluble dispersing agent having a crosslinking property,
(D) a self-emulsifying type urethane resin, and
(E) a block isocyanate compound.

The aqueous pigment ink in the present invention can be obtained by, for example, preparing a pigment dispersion from at least:

(F) a pigment, (G) an aqueous liquid as a solvent or dispersion medium, and, (C) a water-soluble dispersing agent having a crosslinking property, and mixing the pigment dispersion and (D) a self-emulsifying type urethane resin, (E) a block isocyanate compound, and (G) an aqueous liquid as a solvent or dispersion medium.

This pigment dispersion may have a pigment solid content of, for example, 5 to 40% by weight, which, however, is not to be construed as limiting.

The aqueous pigment ink blended with these components can be rendered an ink that is suitable for inkjet textile printing by, for example, adjusting the viscosity to a range from 3 to 30 mPa·s at 20° C., or adjusting the surface tension to a range from 20 to 40 mN/m, or adjusting both the viscosity and the surface tension to these ranges, according to the kind and amount of the aqueous liquid as a solvent or dispersion medium, or the kinds and amounts of other components.

Separating coarse pigment particles 500 nm or more in diameter by filter filtration or centrifugation is preferable for obtaining an ink that is suitable for inkjet printing.

In obtaining the aforementioned pigment dispersion, (I) a dispersing aid may be used to supplement the dispersing capacity.

In addition, the aqueous pigment ink in the present invention may be blended with, in addition to the above-described components, for example, a thickener, an ultraviolet absorbent, an antioxidant, a lubricant, a wax, a defoaming agent, an antisetting agent, a crosslinking catalyst, a chelating agent, a surfactant, and the like.

(H) Wet Dispersion Using a Milling Machine

The above-described pigment dispersion used to prepare the aqueous pigment ink in the present invention can be obtained by mixing (F) a pigment, (G) an aqueous liquid as a solvent or dispersion medium, and (C) a water-soluble dispersing agent having a crosslinking property, as well as (I) a dispersing aid added as required, and performing wet dispersion using glass beads, zirconia beads, titania beads, or the like in a milling machine (beads mill).

(I) Dispersing Aid

In obtaining a pigment dispersion, a dispersing aid can be used as required. By using an anionic surfactant as a dispersing aid to supplement the dispersing capacity of (C) a water-soluble dispersing agent having a crosslinking property, it is possible to obtain improved dispersion efficiency, pigment particle micronization, and time-related stability by suppression of separation, thickening, and the like during storage of the aqueous pigment ink.

Examples of anionic surfactants preferred as dispersing aids include polyoxyethylene styrenated phenyl ether sulfate or polyoxyethylene alkyl ether sulfate having an HLB of 10 to 16. This is because a pigment dispersion that has little impact on the color fastness and excellent long-term storage stability can be obtained. However, the anionic surfactant that can be used as a dispersing aid in the present invention is not limited to these examples.

When using a dispersing aid, the blending ratio (weight) is preferably not more than 0.3 of the dispersing aid relative to 1 of pigment. If the ratio of the dispersing aid is more than 0.3, water resistance reduction can occur.

(8) Inkjet Printing Machine

The choice of inkjet printing machine for printing an aqueous pigment ink by an inkjet process in the printing step is not particularly limited, but one having a piezo type nozzle head is preferred. In the case of a thermal type nozzle head, when used for a long time, the block isocyanate compound in the ink can undergo thermal cleavage, accelerating the crosslinking reaction. The piezo type is free from this fear; the ink can be stably discharged for a long time.

Examples of such printing machines include, but of course are not limited to, EPSON PX-V700, EPSON PM-40000PX, Mimaki TX-1600S, FUJIFILM DMP-2831, MASTERMIND MMP8130 (all are trade names), and the like.

(9) Heat Treatment Process

In the method for inkjet textile printing of the present invention, at least the portion printed with an aqueous pigment ink of a textile fiber product whose pretreated portion has been printed with the aqueous pigment ink by an inkjet process in the printing step is subjected to a heat treatment (e.g., at 100° C. or higher).

Thereby the block isocyanate compound used in the pretreatment and/or the block isocyanate compound in the aqueous pigment ink and the water-soluble dispersing agent having a crosslinking property and/or the crosslinking functional group in the self-emulsifying type urethane resin in the aqueous pigment ink crosslink with each other, whereby they become a water-insoluble integral entity, and, while in a state containing the pigment, bind firmly to the fiber in the textile fiber product and pigment-color the textile fiber product.

Heating temperature and heating time for the heat treatment are chosen in view of the heat resistance of the subject textile fiber product, the characteristics of the substances used for textile printing, and the like. To achieve sufficient crosslinking, the block isocyanate compound is required to have a temperature of not lower than the dissociation reaction temperature thereof, and the reaction is carried out usually at 100 to 220° C. for 1 to 20 minutes, preferably at 100 to 150° C. for 3 to 10 minutes, still more preferably at 120 to 150° C. for 3 to 5 minutes.

(10) Post-Treatment

By performing a post-treatment via an indispensable heat treatment process for at least the portion printed with an aqueous pigment ink of a textile fiber product printed with the aqueous pigment ink by an inkjet process in the printing step, additional effects can be obtained, such as improved feeling, improved color fastness, improved slippage, prevention of electrification, and prevention of discoloration.

The post-treatment can be performed by applying one kind or two kinds or more of acrylic resin emulsions, urethane resin emulsions, crosslinking agents, plasticizers, surfactants, silicone-based softening agents, and the like (post-treatment agents) to at least a required portion of the textile fiber product by padding process, coating process, screen printing process, inkjet process, spraying process, or the like. These post-treatment agents may be blended with indispensable additives such as an antistatic agent, ultraviolet absorbent, antioxidant, defoaming agent, and drying inhibitor.

EXAMPLES

The present invention is hereinafter described in further detail with reference to Examples, to which, however, the present invention is not limited. Note that "parts" as mentioned in Examples and elsewhere mean "parts by weight" unless otherwise stated.

Example 1

<Pretreatment Agent 1>

5 parts of didecyldimethylammonium chloride, 5 parts of Fixer N (trade name for a block isocyanate compound manufactured by Matsui Shikiso Chemical Co., Ltd.), and 90 parts of water were mixed with stirring to yield a pretreatment agent 1.

<Method of Pretreatment>

Cotton broadcloth, polyester crepe de chine, and T/C broadcloth were each padded with the pretreatment agent 1 at a wringing rate of 60% and then dried at 60° C. for 10 minutes to yield respective pretreated cloths 1.

<Water-Soluble Dispersing Agent 1>

One stirrer, one thermometer, and three dropping funnel were set to a 1-liter glass flask, 442 parts of water and 15 parts of AQUARON KH-10 (trade name for a reactive surfactant manufactured by Dai-ichi Kogyo Seiyaku Co., Ltd.) were placed in the flask, the atmosphere was replaced with nitrogen with stirring, and the flask was heated to 60° C.

Subsequently, various materials were added drop by drop to the flask:

a mixture of 100 parts of butyl acrylate, 20 parts of ethyl acrylate, 30 parts of 2-ethylhexyl acrylate, 150 parts of methacrylic acid, and 21 parts of THIOKALCOL 20 (trade name for a chain transfer agent manufactured by Kao Corporation) from the first dropping funnel, an aqueous solution of 3 parts of ammonium persulfate in 108 parts of distilled water from the second dropping funnel, and an aqueous solution of 3 parts of sodium hydrogen sulfite in 108 parts of distilled water from the third dropping funnel.

This dropwise addition was performed concurrently from the three dropping funnels over 4 hours while keeping the temperature of the mixture in the flask at 60° C.

After completion of the dropwise addition, a reaction was carried out at 60° C. for 1 hour. Subsequently, the reaction product was allowed to cool down to 20° C. and then filtered through a wire net to yield an emulsion polymer having a solid content of 34%. Triethylamine was added to the emulsion polymer to yield a water-soluble dispersing agent 1 having a pH of 8.2 and a molecular weight of 8,000.

<Pigment Dispersion 1>

20 parts of a pigment, 6.5 parts of the water-soluble dispersing agent 1, 50 parts of water, 20 parts of diethylene glycol, 3 parts of urea, and 0.5 parts of SN-DEFOAMER 777 (trade name for a defoaming agent manufactured by San Nopco Limited) were mixed, and this mixture, along with zirconia beads 0.3 mm in diameter, was applied to a milling machine and dispersed for 1 hour. Thereafter, the zirconia beads were removed, and the dispersion was filtered through a membrane filter having a pore diameter of 0.5 μm to yield a pigment dispersion 1.

Pigment dispersions prepared using as pigments C.I. Pigment yellow 17, C.I. Pigment Red 122, C.I. Pigment Blue 15:3, and carbon black, corresponding to yellow, magenta, cyan, and black, respectively, were named pigment dispersion 1-Y, pigment dispersion 1-M, pigment dispersion 1-C, and pigment dispersion 1-K, respectively.

<Aqueous Pigment Ink 1>

20 parts of the pigment dispersion 1, 18 parts of glycerin, 20 parts of SUPERFLEX 460 (trade name for a self-emulsifying type urethane resin manufactured by Dai-ichi Kogyo Seiyaku Co., Ltd.), 28 parts of water, and 9 parts of Fixer N were mixed with stirring, 5 parts of water or ethylene glycol was added to obtain a viscosity of 4 mPa·s at 20° C. and a surface tension of 32 mN/m, whereby an aqueous pigment ink 1 was obtained.

Aqueous pigment inks 1 prepared using the pigment dispersions 1-Y, 1-M, 1-C, and 1-K were named aqueous pigment inks 1-Y, 1-M, 1-C, and 1-K, respectively.

For the aqueous pigment inks with various colors obtained, particle size was measured using a particle size analyzer (trade name: Microtrac UPA-EX150; manufactured by Nikkiso Co., Ltd.); no coarse particles having a maximum particle diameter of 500 nm or more were detected.

For the various colors of the aqueous pigment inks obtained, time-related stability at 60° C. for 1 week was examined; no remarkable change was observed in the viscosity or pigment particle diameter.

<Print Evaluation Test>

The aqueous pigment inks of various colors 1-Y, 1-M, 1-C, and 1-K were each filled in an inkjet print tester MMP813BT manufactured by Mastermind K.K., and inkjet-printed on each pretreated cloth 1; thereafter, the printed cloths were dried at 60° C. for 10 minutes and heated at 150° C. for 3 minutes; colored cloths without bleeding and with high brilliancy, high color density, and soft feeling were obtained.

<Print Stability Test>

The aqueous pigment inks of various colors 1-Y, 1-M, 1-C, and 1-K were each filled in an inkjet print tester MMP813BT manufactured by Mastermind K.K., and continuously printed on each pretreated cloth 1 for 10 minutes; good discharge stability and print stability were exhibited without defective pixels, print irregularity, and the like.

Thereafter, the inkjet print tester was stopped, and while in a state filled in the inkjet print tester, the aqueous pigment inks of various colors were allowed to stand at room temperature for 1 week; thereafter, head cleaning was performed, and the inks were continuously printed on each pretreated cloth 1 for 10 minutes; good discharge stability and print stability were exhibited without defective pixels, print irregularity, and the like as before the standing.

<Washing Fastness Test>

The colored cloths obtained were subjected to a washing fastness test in accordance with the JIS L-0217 103 method×5 times (5-grade rating method); good color fastness to washing was exhibited: grade 4 for all of cotton broadcloth, polyester crepe de chine, and T/C broadcloth.

<Test for Color Fastness to Rubbing>

The colored cloths obtained were subjected to a test for color fastness to rubbing in accordance with the JIS L-0849 test for color fastness to rubbing (5-grade rating method); good fastness to rubbing was exhibited: grade 4 for all of cotton broadcloth, polyester crepe de chine, and T/C broadcloth in dry rubbing, and grade 3-4 for cotton broadcloth and T/C broadcloth and grade 3 for polyester crepe de chine in wet rubbing.

Example 2

<Pretreatment Agent 2>

5 parts of distearyldimethylammonium chloride, 5 parts of Fixer N, and 90 parts of water were mixed with stirring to yield a pretreatment agent 2.

<Method of Pretreatment>

Cotton broadcloth, polyester crepe de chine, and T/C broadcloth were each padded with the pretreatment agent 2 and then dried at 60° C. for 10 minutes in the same manner as Example 1 to yield respective pretreated cloths 2.

<Water-Soluble Dispersing Agent 2>

Starting materials were treated in the same manner as the obtainment of a water-soluble dispersing agent 1 in Example 1 except that the monomers in the first dropping funnel were replaced with 140 parts of butyl acrylate, 20 parts of ethyl acrylate, 30 parts of 2-ethylhexyl acrylate, 80 parts of methacrylic acid, 10 parts of acrylic acid, and 20 parts of hydroxyethyl acrylate, to yield a water-soluble dispersing agent 2 having a pH of 8.2 and a molecular weight of 7,000.

<Pigment Dispersion 2>

20 parts of pigment, 28 parts of water-soluble dispersing agent 2, 48.5 parts of water, 20 parts of diethylene glycol, 3 parts of urea, and 0.5 parts of SN-DEFOAMER 777 were mixed, and this mixture, along with zirconia beads 0.3 mm in diameter, was applied to a milling machine and dispersed for 1 hour. Thereafter, the zirconia beads were removed, and the dispersion was filtered through a membrane filter with a pore diameter of 0.5 μm to yield a pigment dispersion 2.

Pigment dispersions were prepared using the same pigments corresponding to yellow, magenta, cyan, and black as in Example 1, and named pigment dispersions 2-Y, 2-M, 2-C, and 2-K, respectively.

<Aqueous Pigment Ink 2>

20 parts of the pigment dispersion 2, 18 parts of glycerin, 20 parts of PERMARIN UA-300 (trade name for a self-emulsifying type urethane resin manufactured by Sanyo Chemical Industries, Ltd.), 28 parts of water, and 9 parts of Fixer N were mixed with stirring, and 5 parts of water or ethylene glycol was added to obtain a viscosity of 5 mPa·s at 20° C. and a surface tension of 33 mN/m, whereby an aqueous pigment ink 2 was obtained.

Aqueous pigment inks 2 prepared using the pigment dispersions 2-Y, 2-M, 2-C, and 2-K were named aqueous pigment inks 2-Y, 2-M, 2-C, and 2-K, respectively.

For the aqueous pigment inks with various colors obtained, particle size was measured in the same manner as Example 1; no coarse particles having a maximum particle diameter of 500 nm or more were detected.

For the various colors of the aqueous pigment inks obtained, time-related stability at 60° C. for 1 week was examined; no remarkable change was observed in the viscosity or pigment particle diameter.

<Print Evaluation Test>

The aqueous pigment inks 2-Y, 2-M, 2-C, and 2-K were subjected to a print evaluation test on the pretreated cloth 2 in the same manner as Example 1; colored cloths without bleeding and with high brilliancy, high color density, and soft feeling were obtained.

<Print Stability Test>

The aqueous pigment inks 2-Y, 2-M, 2-C, and 2-K were subjected to a print stability test using the pretreated cloth 2 in the same manner as Example 1; good discharge stability and print stability were exhibited both before and after they were allowed to stand.

<Washing Fastness Test>

The colored cloths obtained were subjected to a washing fastness test in the same manner as Example 1; good color fastness to washing was exhibited: grade 4 for all of cotton broadcloth, polyester crepe de chine, and T/C broadcloth.

<Test for Color Fastness to Rubbing>

The colored cloths obtained were subjected to a test for color fastness to rubbing in the same manner as Example 1; good color fastness to rubbings was exhibited: grade 4 for all of cotton broadcloth, polyester crepe de chine, and T/C broadcloth in dry rubbing, and grade 3-4 for cotton broadcloth and T/C broadcloth and grade 3 for polyester crepe de chine in wet rubbing.

Example 3

<Pretreatment Agent 3>

5 parts of didecyldimethylammonium chloride, 5 parts of AQB-102 (trade name for a block isocyanate compound manufactured by Nippon Polyurethane Industry Co., Ltd.), and 90 parts of water were mixed with stirring to yield a pretreatment agent 3.

<Method of Pretreatment>

Cotton broadcloth, polyester crepe de chine, and T/C broadcloth were each padded with the pretreatment agent 3 and then dried at 60° C. for 10 minutes in the same manner as Example 1 to yield respective pretreated cloths 3.

<Aqueous Pigment Ink 3>

20 parts of the pigment dispersion 1 of Example 1, 18 parts of glycerin, 20 parts of PERMARIN UA-300, 28 parts of water, and 9 parts of AQB-102 were mixed with stirring, 5 parts of water or ethylene glycol was added to obtain a viscosity of 5 mPa·s at 20° C. and a surface tension of 32 mN/m, whereby an aqueous pigment ink 3 was obtained.

Aqueous pigment inks 3 prepared using the pigment dispersions 1-Y, 1-M, 1-C, and 1-K were named aqueous pigment inks 3-Y, 3-M, 3-C, and 3-K, respectively.

For the aqueous pigment inks with various colors obtained, particle size was measured in the same manner as Example 1; no coarse particles having a maximum particle diameter of 500 nm or more were detected.

For the various colors of the aqueous pigment inks obtained, time-related stability at 60° C. for 1 week was examined; no remarkable change was observed in the viscosity or pigment particle diameter.

<Print Evaluation Test>

The aqueous pigment inks 3-Y, 3-M, 3-C, and 3-K were subjected to a print evaluation test on the pretreated cloth 3 in the same manner as Example 1; colored cloths without bleeding and with high brilliancy, high color density, and soft feeling were obtained.

<Print Stability Test>

The aqueous pigment inks 3-Y, 3-M, 3-C, and 3-K were subjected to a print stability test using the pretreated cloth 3 in the same manner as Example 1; good discharge stability and print stability were exhibited both before and after the inks were allowed to stand.

<Washing Fastness Test>

The colored cloths obtained were subjected to a washing fastness test in the same manner as Example 1; good color fastness to washing was exhibited: grade 4 for all of cotton broadcloth, polyester crepe de chine, and T/C broadcloth.

<Test for Color Fastness to Rubbing>

The colored cloths obtained were subjected to a test for color fastness to rubbing in the same manner as Example 1; good color fastness to rubbings was exhibited: grade 4 for all of cotton broadcloth, polyester crepe de chine, and T/C broadcloth in dry rubbing, and grade 3-4 for cotton broadcloth and T/C broadcloth and grade 3 for polyester crepe de chine in wet rubbing.

Example 4

<Pigment Dispersion 3>

20 parts of a pigment, 6.5 parts of the water-soluble dispersing agent 2 of Example 2, 6 parts of HITENOL NF13 (dispersing aid: trade name for an anionic surfactant manufactured by Dai-ichi Kogyo Seiyaku Co., Ltd.), 44 parts of water, 20 parts of diethylene glycol, 3 parts of urea, and 0.5 parts of SN-DEFOAMER 777 were mixed, and this mixture, along with zirconia beads 0.3 mm in diameter, was applied to a milling machine and dispersed for 1 hour. Thereafter, the zirconia beads were removed, and the dispersion was filtered through a membrane filter with a pore diameter of 0.5 μm to yield a pigment dispersion 3.

Pigment dispersions were prepared using the same pigments corresponding to yellow, magenta, cyan, and black as in Example 1, and named pigment dispersions 3-Y, 3-M, 3-C, and 3-K, respectively.

<Aqueous Pigment Ink 4>

20 parts of the pigment dispersion 3, 18 parts of glycerin, 20 parts of SUPERFLEX 460, 28 parts of water, and 9 parts of Fixer N were mixed with stirring, and 5 parts of water or ethylene glycol were added to obtain a viscosity of 5 mPa·s at 20° C. and a surface tension of 31 mN/m, whereby an aqueous pigment ink 4 was obtained.

Aqueous pigment inks 4 prepared using the pigment dispersions 3-Y, 3-M, 3-C, and 3-K were named aqueous pigment inks 4-Y, 4-M, 4-C, and 4-K, respectively.

For the aqueous pigment inks with various colors obtained, particle size was measured in the same manner as Example 1; no coarse particles having a maximum particle diameter of 500 nm or more were detected.

For the various colors of the aqueous pigment inks obtained, time-related stability at 60° C. for 1 week was examined; no remarkable change was observed in the viscosity or pigment particle diameter.

<Print Evaluation Test>

The aqueous pigment inks 4-Y, 4-M, 4-C, and 4-K were subjected to a print evaluation test on the pretreated cloth 1 in the same manner as Example 1; colored cloths without bleeding and with high brilliancy, high color density, and soft feeling were obtained.

<Print Stability Test>

The aqueous pigment inks 4-Y, 4-M, 4-C, and 4-K were subjected to a print stability test using the pretreated cloth 1 in the same manner as Example 1; good discharge stability and print stability were exhibited both before and after the inks were allowed to stand.

<Washing Fastness Test>

The colored cloths obtained were subjected to a washing fastness test in the same manner as Example 1; good color fastness to washing was exhibited: grade 4 for all of cotton broadcloth, polyester crepe de chine, and T/C broadcloth.

<Test for Color Fastness to Rubbing>

The colored cloths obtained were subjected to a test for color fastness to rubbing in the same manner as Example 1; good color fastness to rubbings was exhibited: grade 4 for all of cotton broadcloth, polyester crepe de chine, and T/C broadcloth in dry rubbing, and grade 3 for cotton broadcloth and T/C broadcloth and grade 2-3 for polyester crepe de chine in wet rubbing.

Example 5

<Method of Pretreatment>

Black cotton broadcloth was padded with the pretreatment agent 1 and then dried at 60° C. for 10 minutes in the same manner as Example 1 to yield a pretreated cloth 5.

<Pigment Dispersion 5>

Starting materials were treated in the same manner as Example 1 except that titanium oxide was used as a pigment, to yield a pigment dispersion 5-W.

<Aqueous Pigment Ink 5>

50 parts of the pigment dispersion 5-W, 18 parts of glycerin, 10 parts of SUPERFLEX 460, 12 parts of water, and 5 parts of Fixer N were mixed with stirring, and 5 parts of water or ethylene glycol was added to obtain a viscosity of 5 mPa·s at 20° C. and a surface tension of 32 mN/m, whereby an aqueous pigment ink 5-W was obtained.

For the aqueous pigment ink 5-W obtained, particle size was measured in the same manner as Example 1; no coarse particles having a maximum particle diameter of 500 nm or more were detected.

For the aqueous pigment ink 5-W obtained, time-related stability at 60° C. for 1 week was examined; no remarkable change was observed in the viscosity or pigment particle diameter.

<Print Evaluation Test>

The aqueous pigment ink 5-W was filled in an inkjet print tester MMP813BT, and inkjet-printed on the pretreated cloth 5 to form a white masking layer. The aqueous pigment inks 1-Y, 1-M, 1-C, and 1-K were inkjet-printed on the white masking layer in the same manner as Example 1, thereafter, the cloth was dried at 60° C. for 10 minutes and heated at 150° C. for 3 minutes; colored cloths without bleeding and with high brilliancy, high color density, and soft feeling were obtained.

<Washing Fastness Test>

The colored cloths obtained were subjected to a washing fastness test in the same manner as Example 1; good color fastness to washing was exhibited at grade 4.

<Test for Color Fastness to Rubbing>

The colored cloths obtained were subjected to a test for color fastness to rubbing in the same manner as Example 1; good color fastness to rubbings was exhibited: grade 3-4 in dry rubbing and grade 3 in wet rubbing.

Example 6

<Post-Treatment>

The various colored cloths of Example 1 to 5 were each padded with a post-treatment agent consisting of 5 parts of Fixer N, 3 parts of Faster XA (trade name for an acrylic resin emulsion manufactured by Matsui Shikiso Chemical Co., Ltd.), 5 parts of Abrasion XF (trade name for a silicone-based softening agent manufactured by Matsui Shikiso Chemical Co., Ltd.), and 87 parts of water at a wringing rate of 65%, and dried at 60° C. for 10 minutes and then heated at 150° C. for 3 minutes.

The post-treated cloths obtained were tested in the same manner as the washing fastness test and test for color fastness to rubbing performed in the various Examples; various properties of fastness improved by about 0.5 grades compared with non-post-treated colored cloths, and the feeling became softer.

Comparative Example 1

The aqueous pigment inks 1-Y, 1-M, 1-C, and 1-K were subjected to a print evaluation test in the same manner as Example 1 except that no pretreatment was performed; the colored cloths obtained had unsatisfactory quality with severe bleeding and poor brilliancy.

Comparative Example 2

<Pretreatment Agent NG1>

5 parts of didecyldimethylammonium chloride and 95 parts of water were mixed with stirring to yield a pretreatment agent NG1.

<Method of Pretreatment>

Cotton broadcloth, polyester crepe de chine, and T/C broadcloth were each padded with the pretreatment agent NG1 and then dried at 60° C. for 10 minutes in the same manner as Example 1 to yield respective pretreated cloths NG1.

<Print Evaluation Test>

The aqueous pigment inks 1-Y, 1-M, 1-C, and 1-K were subjected to a print evaluation test on the pretreated cloths NG1 in the same manner as Example 1; colored cloths without bleeding and with high brilliancy, high color density, and soft feeling were obtained.

<Washing Fastness Test>

The colored cloths obtained were subjected to a washing fastness test in the same manner as Example 1; the washing fastness was worse than in Example 1: grade 3 for all of cotton broadcloth, polyester crepe de chine, and T/C broadcloth.

<Test for Color Fastness to Rubbing>

The colored cloths obtained were subjected to a test for color fastness to rubbing in the same manner as Example 1; the color fastness to rubbing was worse than in Example 1: grade 3 for all of cotton broadcloth, polyester crepe de chine, and T/C broadcloth in dry rubbing, and grade 2-3 for cotton broadcloth and T/C broadcloth and grade 2 for polyester crepe de chine in wet rubbing.

Comparative Example 3

<Pretreatment Agent NG2>

5 parts of Fixer N and 95 parts of water were mixed with stirring to yield a pretreatment agent NG2.

<Method of Pretreatment>

Cotton broadcloth, polyester crepe de chine, and T/C broadcloth were each padded with the pretreatment agent NG2 and then dried at 60° C. for 10 minutes in the same manner as Example 1 to yield respective pretreated cloths NG2.

<Print Evaluation Test>

The aqueous pigment inks 1-Y, 1-M, 1-C, and 1-K were subjected to a print evaluation test on the pretreated cloths NG2 in the same manner as Example 1; the colored cloths had unsatisfactory quality with severe bleeding and poor brilliancy.

Comparative Example 4

<Pretreatment Agent NG3>

5 parts of lauryltrimethylammonium chloride, 5 parts of Fixer N, and 90 parts of water were mixed with stirring to yield a pretreatment agent NG3.

<Method of Pretreatment>

Cotton broadcloth, polyester crepe de chine, and T/C broadcloth were each padded with the pretreatment agent NG3 and then dried at 60° C. for 10 minutes in the same manner as Example 1 to yield respective pretreated cloths NG3.

<Print Evaluation Test>

The aqueous pigment inks 1-Y, 1-M, 1-C, and 1-K were subjected to a print evaluation test on the pretreated cloths NG3 in the same manner as Example 1; colored cloths without bleeding and with high brilliancy, high color density, and soft feeling were obtained.

<Washing Fastness Test>

The colored cloths obtained were subjected to a washing fastness test in the same manner as Example 1; the washing fastness was worse than in Example 1: grade 3 for all of cotton broadcloth, polyester crepe de chine, and T/C broadcloth.

<Test for Color Fastness to Rubbing>

The colored cloths obtained were subjected to a test for color fastness to rubbing in the same manner as Example 1; the color fastness to rubbing was worse than in Example 1: grade 3-4 for all of cotton broadcloth, polyester crepe de chine, and T/C broadcloth in dry rubbing, and grade 2-3 for cotton broadcloth and T/C broadcloth and grade 2 for polyester crepe de chine in wet rubbing.

Comparative Example 5

<Pretreatment Agent NG4>

5 parts of SAFTOMER ST-3300 (trade name for a cationic acrylic resin manufactured by Mitsubishi Chemical Corporation), 5 parts of Fixer N, and 90 parts of water were mixed with stirring to yield a pretreatment agent NG4.

<Method of Pretreatment>

Cotton broadcloth, polyester crepe de chine, and T/C broadcloth were each padded with the pretreatment agent NG4 and then dried at 60° C. for 10 minutes in the same manner as Example 1 to yield respective pretreated cloths NG4.

<Print Evaluation Test>

The aqueous pigment inks 1-Y, 1-M, 1-C, and 1-K were subjected to a print evaluation test on the pretreated cloths NG4 in the same manner as Example 1; colored cloths of unsatisfactory quality with slight bleeding, slightly poor brilliancy, low color density, and hard feeling were obtained.

Comparative Example 6

<Water-Soluble Dispersing Agent NG1>

Starting materials were treated in the same manner as the obtainment of a water-soluble dispersing agent 1 in Example 1 except that the monomers in the first dropping funnel were replaced with 50 parts of butyl acrylate and 250 parts of methacrylic acid, to yield a water-soluble dispersing agent NG1 having a pH of 8.1 and a molecular weight of 7,500.

<Pigment Dispersion NG1>

20 parts of a pigment, 6.5 parts of the water-soluble dispersing agent NG1, 50 parts of water, 20 parts of diethylene glycol, 3 parts of urea, and 0.5 parts of SN-DEFOAMER 777 were mixed, and this mixture, along with zirconia beads 0.3 mm in diameter, was applied to a milling machine and dispersed for 1 hour; the pigment dispersion obtained was found to be highly viscous and unusable for obtaining the aqueous pigment ink in the present invention.

Comparative Example 7

<Pigment Dispersion NG2>

20 parts of a pigment, 7 parts of EMULGEN 108 (trade name for a nonionic surfactant manufactured by Kao Corporation), 49.5 parts of water, 20 parts of diethylene glycol, 3 parts of urea, and 0.5 parts of SN-DEFOAMER 777 were mixed, and this mixture, along with zirconia beads 0.3 mm in diameter, was applied to a milling machine and dispersed for 1 hour. Thereafter, the zirconia beads were removed, and the dispersion was filtered through a membrane filter having pore diameter of 0.5 μm to yield a pigment dispersion NG2.

Pigment dispersions were prepared using the same pigments corresponding to yellow, magenta, cyan, and black as in Example 1, and named pigment dispersions NG2-Y, NG2-M, NG2-C, and NG2-K, respectively.

<Aqueous Pigment Inks NG1>

Starting materials were treated in the same manner as Example 1 except that the pigment dispersions 1-Y, 1-M, 1-C, and 1-K were replaced with the pigment dispersions NG2-Y, NG2-M, NG2-C, and NG2-K, to yield aqueous pigment inks NG1-Y, NG1-M, NG1-C, and NG1-K.

The pretreated cloth 1 was inkjet-printed in the same manner as Example 1 except that the aqueous pigment inks 1-Y, 1-M, 1-C, and 1-K were replaced with the aqueous pigment inks NG1-Y, NG1-M, NG1-C, and NG1-K, and the colored cloths obtained were subjected to a washing fastness test and test for color fastness to rubbing in the same manner as Example 1; the results were worse than in Example 1: grade 2 of washing fastness for all pretreated cloths 1 and grade 3 of color fastness to rubbing for all cloths in dry rubbing and grade 2 for cotton broadcloth and T/C broadcloth in wet rubbing.

Comparative Example 8

<Aqueous Pigment Inks NG2>

Starting materials were treated in the same manner as Example 2 except that PERMARIN UA-300 in the aqueous pigment ink 2 was replaced with SUPERFLEX E-4800 (forcibly emulsified urethane resin manufactured by Dai-ichi Kogyo Seiyaku Co., Ltd.), to yield aqueous pigment inks NG2-Y, NG2-M, NG2-C, and NG2-K.

For the aqueous pigment inks with various colors obtained, particle size was measured in the same manner as Example 1; no coarse particles having a maximum particle diameter of 500 nm or more were detected.

However, for the various colors of the aqueous pigment inks obtained, time-related stability at 60° C. for 1 week was examined; the viscosity increased, and coarse particles 500 nm or more in diameter were detected.

The aqueous pigment inks NG2-Y, NG2-M, NG2-C, and NG2-K were subjected to a print stability test using the pretreated cloth 2 in the same manner as Example 1; defective pixels and print irregularity due to drying were seen, and the print stability was poor. Furthermore, the inkjet print tester was stopped, and, while in a state filled in the inkjet print tester, the aqueous pigment inks were allowed to stand at room temperature for 1 week; thereafter, the inkjet print tester did not restore the capability of satisfactory inkjet printing, and stable discharge was not achieved, even after head cleaning was performed.

Comparative Example 9

<Aqueous Pigment Inks NG3>

Starting materials were treated in the same manner as Example 2 except that Fixer N in the aqueous pigment ink 2 was replaced with water, to yield aqueous pigment inks NG3-Y, NG3-M, NG3-C, NG3-K.

The pretreated cloth 1 was inkjet-printed in the same manner as Example 1 except that the aqueous pigment inks 1-Y, 1-M, 1-C, and 1-K were replaced with the aqueous pigment inks NG3-Y, NG3-M, NG3-C, and NG3-K, and the colored cloths obtained were subjected to a washing fastness test and a test for color fastness to rubbing in the same manner as Example 1; the results were worse than in Example 1: grade 2-3 of washing fastness for all pretreated cloths 1, and grade 3-4 of color fastness to rubbing for all cloths in dry rubbing and grade 2-3 for cotton broadcloth and T/C broadcloth in wet rubbing.

The above-described results of Examples and Comparative Examples revealed that the constituent components of (A) a quaternary ammonium salt type cationic surfactant represented by the formula (1), (B) a block isocyanate compound, (C) a water-soluble dispersing agent having a crosslinking property, (D) a self-emulsifying type urethane resin, and (E) a block isocyanate compound in the present invention are of particular significance.

What is claimed is:

1. A method for inkjet textile printing comprising a pretreatment step for performing a pretreatment on a textile fiber product and a printing step for printing an aqueous pigment ink on the pretreated portion of the textile fiber product by an inkjet process, wherein said pretreatment is performed by applying at least:

(A) a quaternary ammonium salt type cationic surfactant represented by formula (1) below, and (B) a block isocyanate compound to the entire textile fiber product or a required portion thereof, and said aqueous pigment ink comprises at least a pigment, an aqueous liquid as a solvent or dispersion medium, and:

(C) a water-soluble dispersing agent having a crosslinking property, (D) a self-emulsifying type urethane resin, which is not water-soluble, and (E) a block isocyanate compound

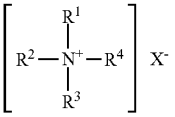

(1)

in formula (1), two of $R^1$ to $R^4$ mutually independently represent an alkyl group having 8 to 18 carbon atoms, the remaining two mutually independently represent a methyl group or an ethyl group, and $X^-$ represents an anion.

2. The method for inkjet textile printing according to claim 1, wherein (B) the block isocyanate compound is a compound resulting from blocking of the isocyanate group in trimethylolpropane adduct form or isocyanurate form of:

hexamethylene diisocyanate, hydrogenated xylylene diisocyanate, isophorone diisocyanate, or dicyclohexylmethane diisocyanate.

3. The method for inkjet textile printing according to claim 2, wherein (B) the block isocyanate compound has been obtained using diethyl malonate, diisopropylamine, 1,2,4-triazole, 3,5-dimethylpyrazole, or 2-butanonoxime as a blocking agent.

4. The method for inkjet textile printing according to claim 1, wherein the aqueous pigment ink is a dispersion liquid containing a dispersed pigment having a maximum particle diameter of not more than 500 nm.

5. The method for inkjet textile printing according to claim 1, wherein (C) the water-soluble dispersing agent having a crosslinking property results from neutralization, with a basic substance, of an emulsion polymer having a molecular weight of 2,000 to 20,000 obtained from:

(1) 20 to 80 parts by weight of a (meth)acrylic acid ester monomer represented by $CH_2{=}CR^5{-}COOR^6$, wherein $R^5$ represents a hydrogen atom or a methyl group, and $R^6$ represents an alkyl group having 2 to 8 carbon atoms, (2) 80 to 20 parts of an aliphatic vinyl monomer having a carboxyl group, and (3) 0 to 20 parts of an aliphatic vinyl monomer having a crosslinking property.

6. The method for inkjet textile printing according to claim 5, wherein (2) the aliphatic vinyl monomer having a carboxyl group is at least one selected from the group consisting of acrylic acid, methacrylic acid, itaconic acid, maleic acid, and fumaric acid.

7. The method for inkjet textile printing according to claim 5, wherein the basic substance is a secondary amine or a tertiary amine.

8. The method for inkjet textile printing according to claim 1, wherein the blending ratio of (C) the water-soluble dispersing agent having a crosslinking property in the aqueous pigment ink ranges from 0.05 to 2.0 parts by weight relative to 1.0 part by weight of the pigment.

9. The method for inkjet textile printing according to claim 1, wherein the aqueous pigment ink contains a polyoxyethylene styrenated phenyl ether sulfate or a polyoxyethylene alkyl ether sulfate as a dispersing aid.

10. The method for inkjet textile printing according to claim 1, wherein (D) the self-emulsifying type urethane resin has been obtained from a composition comprising at least:

an isocyanate and a polyol having a carboxyl group or a sulfonic acid group.

11. The method for inkjet textile printing according to claim 1, wherein the glass transition point (Tg) of (D) the self-emulsifying type urethane resin is −60 to 20° C.

12. The method for inkjet textile printing according to claim 1, wherein (E) the block isocyanate compound is a compound resulting from blocking the isocyanate group in trimethylolpropane adduct form or isocyanurate form of:

hexamethylene diisocyanate, hydrogenated xylylene diisocyanate, isophorone diisocyanate, or dicyclohexylmethane diisocyanate.

13. The method for inkjet textile printing according to claim 12, wherein (E) the block isocyanate compound has been obtained with diethyl malonate, diisopropylamine, 1,2,4-triazole, 3,5-dimethylpyrazole, or 2-butanonoxime as a blocking agent.

14. The method for inkjet textile printing according to claim 1, wherein (E) the block isocyanate compound is water-soluble or self-emulsifying, and wherein the aqueous pigment ink is redispersible.

15. The method for inkjet textile printing according to claim 1, wherein the viscosity of the aqueous pigment ink is 3 to 30 mPa·s at 20° C.

16. The method for inkjet textile printing according to claim 1, wherein the surface tension of the aqueous pigment ink is 20 to 40 mN/m.

17. The method for inkjet textile printing according to claim 1, having a heat treatment step for heating at least a portion on which an aqueous pigment ink is printed of a textile fiber product on which the aqueous pigment ink is printed by an inkjet process in said printing step.

18. The method for inkjet textile printing according to claim 1, wherein the pretreatment is performed by applying at least:

(A) a cationic surfactant represented by the formula (1) above and (B) a block isocyanate compound to the entire textile fiber product or a required portion thereof by a padding process, screen printing process, inkjet process, or spraying process.

19. The method for inkjet textile printing according to claim 1, having a post-treatment step for post-treating at least a portion on which an aqueous pigment ink is printed of a textile fiber product on which the aqueous pigment ink is printed by an inkjet process in said printing step, by a padding process, coating process, screen printing process, inkjet process, or spraying process.

20. The method for inkjet textile printing according to claim 19, wherein the post-treatment is performed by applying at least one of acrylic resin emulsion, urethane resin emulsion, crosslinking agent, plasticizer, surfactant, and silicone-based softening agent to at least a portion on which an aqueous pigment ink is printed of said textile fiber product.

* * * * *